US010995540B2

(12) United States Patent
Ben-Arie

(10) Patent No.: US 10,995,540 B2
(45) **Date of Patent: *May 4, 2021**

(54) SLIDING WINDOW MECHANISM III

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/072,205

(22) Filed: Oct. 16, 2020

(65) Prior Publication Data

US 2021/0032920 A1 Feb. 4, 2021

Related U.S. Application Data

(63) Continuation-in-part of application No. 16/423,164, filed on May 28, 2019, now Pat. No. 10,871,022, which is a continuation-in-part of application No. 15/448,775, filed on Mar. 3, 2017, now Pat. No. 10,344,521.

(60) Provisional application No. 62/303,386, filed on Mar. 4, 2016.

(51) Int. Cl.

| | |
|---|---|
| ***E05F 15/67*** | (2015.01) |
| ***E05D 15/16*** | (2006.01) |
| *E05F 15/41* | (2015.01) |
| *E05F 15/689* | (2015.01) |

(52) U.S. Cl.

CPC ..... *E05F 15/67* (2015.01); *E05D 15/165* (2013.01); *E05F 15/41* (2015.01); *E05F 15/689* (2015.01)

(58) Field of Classification Search

CPC ..... E05F 11/42; E05F 11/423; E05F 15/67; E05F 15/689

See application file for complete search history.

(56) References Cited

U.S. PATENT DOCUMENTS

| | | | | | |
|---|---|---|---|---|---|
| 1,339,879 | A * | 5/1920 | Cima | E05F 11/42 | 49/136 |
| 2,538,329 | A * | 1/1951 | Roos | E05F 11/42 | 49/119 |
| 2,649,301 | A * | 8/1953 | Signore | E05F 11/42 | 49/279 |
| 3,219,335 | A * | 11/1965 | Burridge | E05F 11/382 | 49/360 |

(Continued)

FOREIGN PATENT DOCUMENTS

| | | | | |
|---|---|---|---|---|
| GB | 439837 | A * | 12/1935 | E05F 11/423 |
| GB | 478975 | A * | 1/1938 | E05F 11/423 |

*Primary Examiner* — Marcus Menezes

(57) ABSTRACT

A driving mechanism for sliding a windowed frame guided by an outer frame. The sliding frame is attached to two vertical racks which engage with two pinions. The pinions are connected with a joint axle driven by a couple of engaged bevel gearwheels connected to a crank or to an electric motor. The joint axle with the pinions can be housed in a recess carved at the lower plank of a static window's frame.

A compact motorized option in which each pinion is coupled with a gearbox and both gearboxes are driven by a central electric motor also can be housed entirely in the static window's recess.

The motorized options also include: a control unit for controlling the direction and speed of the sliding, two limit switches for stopping the frame at highest and lowest positions, an electrical overload sensor which detects sudden sliding obstructions and a burglar alarm.

8 Claims, 3 Drawing Sheets

(56) References Cited

U.S. PATENT DOCUMENTS

| | | | | | |
|---|---|---|---|---|---|
| 4,182,078 | A * | 1/1980 | Bartholomew | E05F 11/405 | 49/140 |
| 4,293,752 | A * | 10/1981 | Koenig | H01H 3/142 | 174/117 A |
| 4,402,160 | A * | 9/1983 | Brusasco | E05F 11/426 | 49/352 |
| 4,414,778 | A * | 11/1983 | Carli | E05F 15/67 | 49/199 |
| 4,783,048 | A * | 11/1988 | St. Clair | F16K 3/0281 | 251/129.11 |
| 4,899,492 | A * | 2/1990 | Szerdahelyi | E05F 11/382 | 49/349 |
| 5,440,837 | A * | 8/1995 | Piltingsrud | E05D 15/22 | 49/139 |
| 6,085,825 | A * | 7/2000 | Swink | B60J 5/08 | 160/133 |
| 6,343,436 | B1 * | 2/2002 | Milano, Jr. | E05F 15/67 | 49/362 |
| 10,370,887 | B2 * | 8/2019 | Lange | E05D 13/1207 | |
| 2003/0196383 | A1 * | 10/2003 | Fenelon | E05F 11/525 | 49/349 |
| 2006/0075685 | A1 * | 4/2006 | Gustafson | E05F 15/689 | 49/349 |

* cited by examiner

SLIDING WINDOW MECHANISM III

CROSS-REFERENCE TO RELATED APPLICATIONS

This application is a Continuation in Part of application Ser. No. 16/423,164 Filed on: May 28, 2019

FEDERALLY SPONSORED RESEARCH

Not Applicable.

SEQUENCE LISTING OR PROGRAM

Not Applicable.

TECHNICAL FIELD

The present invention relates to sliding window mechanisms.

PRIOR ART

Many mechanisms were invented for sliding windows especially for sliding windows of vehicles. Usually sliding windows have a framed glass pane. The sliding frame slides between two parallel guides which are attached to the walls and are part of the window's static outer frame. When a window is sliding horizontally, the parallel guides are also horizontal. In the case that the windows are sliding vertically, the parallel guides are vertical. However, we could not find a sliding window mechanism which employs a motorized balanced system of two pinions which are coupled with the same axis and are engaged with two racks attached to the opposite sides of a sliding window frame. Almost all of the other sliding window mechanisms were designed for horizontal sliding and all of them are using a motorized single cable which is attached to the lower side of the sliding frame in a push-pull or a pull-pull mechanism. In a push-pull mechanism one end of the cable is connected to one of the two lower corners of the sliding frame and moves the sliding frame by pushing it in one horizontal direction or pulling it in opposite direction. This push-pull mechanism requires a thick and stiff cable which does not bend when it pushes the sliding frame. In the pull-pull mechanism the two ends of the cable are connected to the two lower corners of the sliding frame and the window is moved by pulling one corner for one direction or pulling the opposite corner for the opposite direction. This mechanism is more efficient because it requires only pulling which can be implemented with much thinner cable.

We have found many other patents which dealt with mechanisms for sliding windows but none is similar to our invention. These patents are listed here: U.S. Pat. No. 6,125,585 to Koneval et al. (Oct. 3, 2000) teaches a push-pull system for horizontal sliding window for cars. There, the cable is connected only at one lower side of the window. U.S. Pat. No. 6,766,617 to Purcell (Jul. 27, 2004) teaches a horizontal sliding window assembly with pull-pull cable mechanism attached to the lower side of the window. U.S. Pat. No. 5,822,922 to Grumm et al. (Oct. 20, 1998) teaches a horizontal sliding window assembly with push-pull 2-cable mechanism attached to the lower side of two sliding windows. U.S. Pat. No. 6,026,611 Ralston et al. (Feb. 22, 2000) teaches a horizontal sliding window assembly with pull-pull cable mechanism attached to the lower side of the window. U.S. Pat. No. 5,784,833 to Sponable et al. (Jul. 28, 1998) teaches a horizontal sliding window assembly with pull-pull cable mechanism attached to the lower side of the window. US 2014/0352600 to Erskine et al. (Dec. 4, 2014) teaches a windshield sliding window/door assembly which uses a single cable attached to one side of the window. US 2004/0094990 Castellon (May 20, 2004) Teaches a car widow assembly which employs a single motorized cable to move the pane. U.S. Pat. No. 9,233,734 Erskine et al. (Jan. 12, 2016) teaches a windshield sliding window/door assembly which uses a single cable attached to one side of the window. U.S. Pat. No. 6,324,788 Koneval et al. (Dec. 4, 2001) teaches a push-pull system for horizontal sliding window for cars. US 2015/0298528 Lahnala (Oct. 22, 2015) teaches a horizontal sliding window assembly with pull-pull cable mechanism attached to the lower side of the window. US 2007/0277443 Dery et al. (Dec. 6, 2007) teaches a horizontal sliding window assembly with push-pull cable mechanism attached to the lower side of the window. US 2012/0091113 Bennett et al. (Apr. 19, 2012) teaches a horizontal sliding window assembly with pull-pull cable mechanism attached to the lower side of the window. US 2010/0122496 Lahnala (May 20, 2010) teaches a horizontal sliding window assembly with pull-pull cable mechanism attached to the lower side of the window. US 2004/0025439 Purcell (Feb. 2, 2004) teaches a horizontal sliding window assembly with pull-pull cable mechanism attached to the lower side of the window.

None of the patents and patent applications described above is similar to our invention.

BRIEF SUMMARY OF THE INVENTION

Our invention includes a mechanism for opening and closing a sliding window. Our mechanism is especially suited for vertical sliding windows which usually require excessive physical effort in opening and closing. A sliding window comprises a pane usually made of transparent material, which is installed in a sliding frame. The sliding frame includes a left vertical plank, a right vertical plank, a lower horizontal plank and an upper horizontal plank. The frame is sliding within an outer frame which has two parallel vertical guides facing one the other. Each guide includes two parallel tracks one beside the other. In each guide, one track guides the sliding frame in moving up or down. A static frame is also installed at the top of the second track. The static frame also has a pane and it is installed in the second track within the guides in the outer frame such that the sliding frame can slide alongside the static frame in the first track. The mechanism for moving the sliding window consists of two parallel rack and pinion mechanisms. The two racks are teethed strips which can be attached along the inner side of the left and right vertical planks of the sliding frame. The driving mechanism of the sliding frame turns a left and a right pinions, which are teethed gearwheels that fit and engage the teethed racks. The left and the right pinions are coupled either with the same axle in the bevel gears option (named as the joint axle) or with two separate axles in the recess motor option (named as output left and right axles). In both cases the pinions are configured to turn at the same speed. The left pinion is engaged with the left rack and the right pinion is engaged with the right rack. Since usually the two racks have equal number of teeth per unit length and the pinions have equal number of teeth per unit angle, the left and right racks are moved up or down at the same vertical speed when the pinions are being turned. Thus, the sliding window mechanism is designed to provide a balanced propulsion i.e. to drive the left side of the frame with the same speed as the right side. Unbalanced propulsion such as having only one sided rack and pinion, generates an unwanted turning moment force applied on the frame that may result in a jerky window motion. The outer appearance of the whole mechanism does not differ from the appearance of non-mechanized sliding window because the driving mechanism is hidden in a recess in the lower horizontal plank of the static frame.

In the bevel gear option there are two options to operate the sliding window mechanism. In the manual option the sliding mechanism is driven by turning a crank which causes the joint axle to turn and move the sliding window up or down. Depending on the mechanical load, the crank can be connected to a crank gearbox which amplifies the output torque. In the motorized option, the sliding mechanism is driven by an electric motor connected to a single or a couple of motor gearboxes which amplify the motor's torque output. This enables to drive larger and heavier sliding frames.

The sliding frame also includes four rollers which are installed at four recesses made in the vertical sliding planks sides facing the tracks that guide the sliding frame in moving up or down. The rollers are actually small wheels with axles which are installed in the frame recesses and protrude above their recesses only with a small part of each wheel which engages with the guiding track. Since the rollers prevent direct engagement of the sliding frame's vertical planks with the guiding track, they significantly reduce the mutual friction between the sliding frame and the guiding tracks and facilitate smoother frame sliding.

In the electric motorized option the electrical system also includes a control unit that enables the user to control the direction and the speed of the sliding motion. In addition, the electrical system is also connected to two limit switches, installed in the upper and lower parts of the outer frame. The limit switches are configured to signal the control unit to stop the electric motor when the sliding frame reaches its highest position and when it reaches its lowest position.

The control unit which controls the motor is also equipped with a safety circuit which includes an electrical overload sensor that can detect a sudden overload of the electric motor's current. Such an overload happens when the sliding window is in the process of closing and it hits an obstruction of a person or an object. Thus, when the load circuit detects an obstruction it instructs the control unit to reverse the motor which then opens the window.

The electrical system also provides a burglar alarm circuit, which sounds the alarm when the sliding frame is forced open while the alarm system is armed. Unlike regular sliding windows, the mechanized sliding window does not need a locking latch because it requires very high force to reverse the mechanical system in order to open the window from outside. In the bevel gear option, the joint axle of the sliding window mechanism can be connected with the crank or with the geared electrical motor by coupling the right end of the joint axle with the left end of the first axle which is also coupled with a first bevel gearwheel at the first axle's right end. For manual window driving, the first bevel gearwheel engages a second bevel gearwheel connected to the crank. For motorized window driving, the first bevel gearwheel is engaged with a third bevel gearwheel attached to the electric motor's output gear's axle.

In the recess motor option, the joint and the first axles are replaced by a recess motor system which includes an electric recess motor mechanically connected to a left gearbox and also to a right gearbox. As a result, the output left axle of the left gearbox and the output right axle of the right gearbox are turning at the same speed when the electric motor turns. The left end of the output left axle is coupled with the left pinion while the right end of the output right axle is coupled with the right pinion. In the recess motor option, the whole recess motor system including the left and right pinions is housed in a recess carved in the lower horizontal plank of the static frame. Since the whole recess motor system is hidden in the recess, the general appearance of the sliding window mechanism does not differ from the appearance of a regular non-motorized sliding window.

BRIEF DESCRIPTION OF THE DRAWINGS

FIG. 1 describes the bevel gear option of the driving mechanism.

FIG. 2 describes the recess motor system option of the driving mechanism.

DETAILED DESCRIPTION OF THE DRAWINGS

Figure 1:
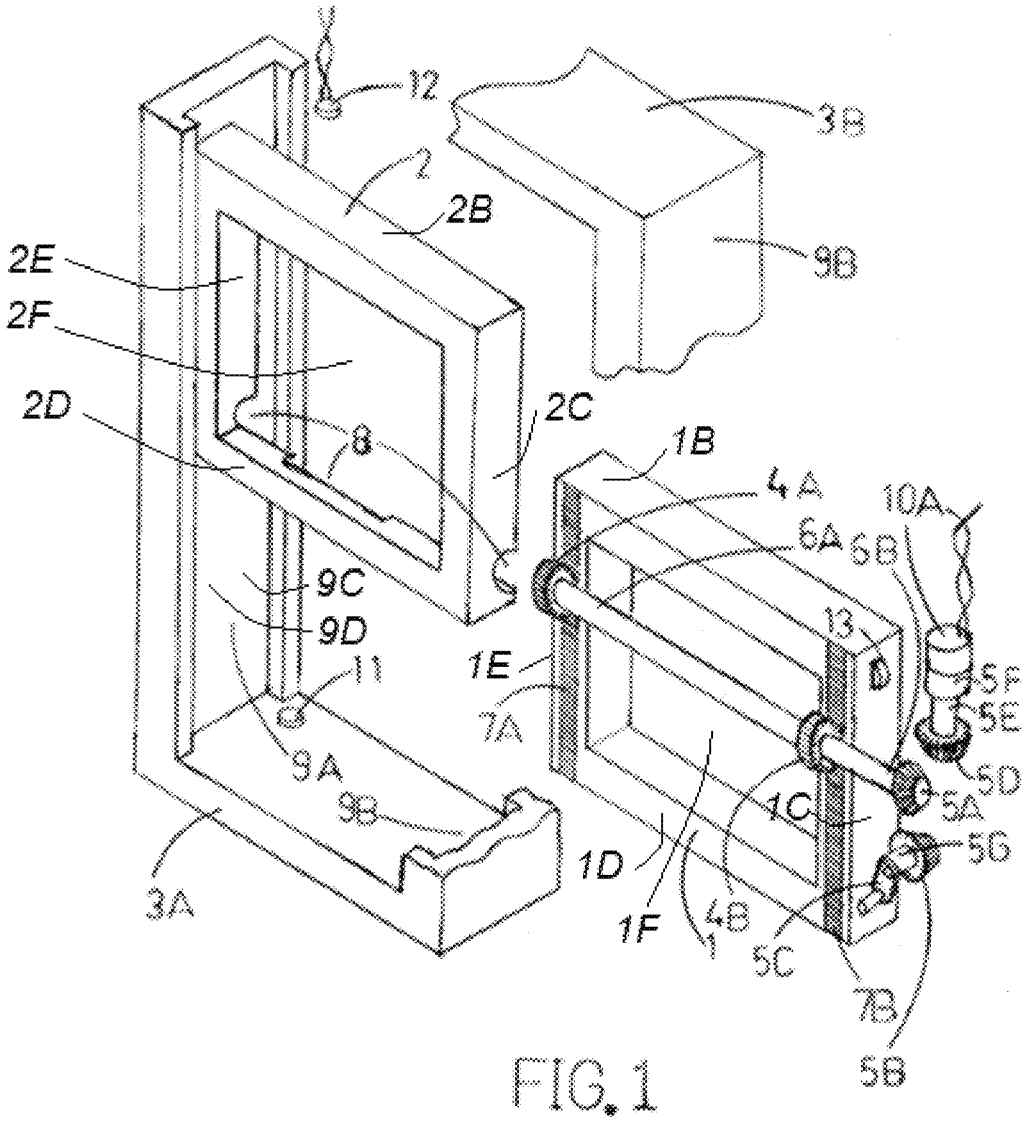
FIG. 1 illustrates in 3D isometric drawing a disassembled view of the entire sliding window mechanism.

FIG. 1 illustrates in 3D isometric drawing a disassembled view of the entire sliding window mechanism. FIG. 1 describes the manual and motorized bevel gear options of the mechanism.

In order to enable better viewing, the sliding frame 1 is illustrated separately from the static frame 2 in FIG. 1. The static frame 2 is installed between the outer frame right vertical guide 9B and the left outer frame vertical guide 9A which is connected to the lower outer horizontal bar 3A and to the upper outer horizontal bar 3B. To allow better viewing, the rest of the outer frame is depicted in pieces. The opposite outer frame's right vertical guide 9B is shown in two pieces where one piece is connected to the outer frame upper horizontal bar 3B and the second piece of outer frame's right vertical guide 9B is connected to the outer frame lower horizontal bar 3A. The static frame 2 also has at its lower static horizontal plank 2D a recess 8 which is configured to house the joint axle 6A which is fused to the left pinion 4A at its left end and to the right pinion 4B at its right end. The joint axle 6A is also coupled at its right end with the left end of the first axle 6B. The right end of the first axle 6B is coupled with the first bevel gearwheel 5A. For manual window driving, the first bevel gearwheel 5A can be engaged with the second bevel gearwheel 5B. For motorized window driving the first bevel gearwheel 5A is engaged with the third bevel gearwheel 5D. The second bevel gearwheel 5B is connected to the crank axle 5G which is attached to the crank 5C. The third bevel gearwheel 5D is connected to the motor gearbox output axle 5E at it lower end. At its upper end, the motor gearbox output axle 5E is connected with the motor gearbox 5F. The motor gearbox 5F is mechanically coupled with the electric motor 10A.

The left pinion 4A is engaged with the left rack 7A which is installed on the inner side of the vertical left sliding plank 1E of the sliding frame 1. The right pinion 4B is engaged with the right rack 7B which is installed on the inner side of the vertical right sliding plank 1C of the sliding frame 1. Two out of four rollers 13 (only one roller is shown in FIG. 1) are installed at two recesses carved at the left side of the vertical left sliding plank 1E of the sliding frame 1 and the other two rollers are installed at two recesses carved at the right side of the vertical right sliding plank 1C of the sliding frame 1.

In the manual window driving option of the driving system, turning the crank 5C turns the crank axle 5G and also the second bevel gearwheel 5B. Turning the second bevel gearwheel 5B which engages with the first bevel gearwheel 5A turns it and also turns the first axle 6B, the right pinion 4B, the joint axle 6A and the left pinion 4A. The left and right turning pinions 4A and 4B move vertically the racks 7B and 7A of the attached sliding frame 1.

In the motorized window driving option of the driving system, turning the electric motor 10A turns the motor gearbox 5F, which also turns the motor gearbox output axle 5E and the third bevel gearwheel 5D. Turning the third bevel gearwheel 5D which engages with the first bevel gearwheel 5A turns it and also turns the first axle 6B, the right pinion 4B, the joint axle 6A and the left pinion 4A. The left and right turning pinions 4A and 4B move vertically the racks 7B and 7A of the attached sliding frame 1.

A lower limit switch 11 and an upper limit switch 12 are electrically connected to the control unit 15A (depicted in FIG. 3) and facilitate stopping the sliding frame at its lowest and highest positions respectively.

Figure 2:
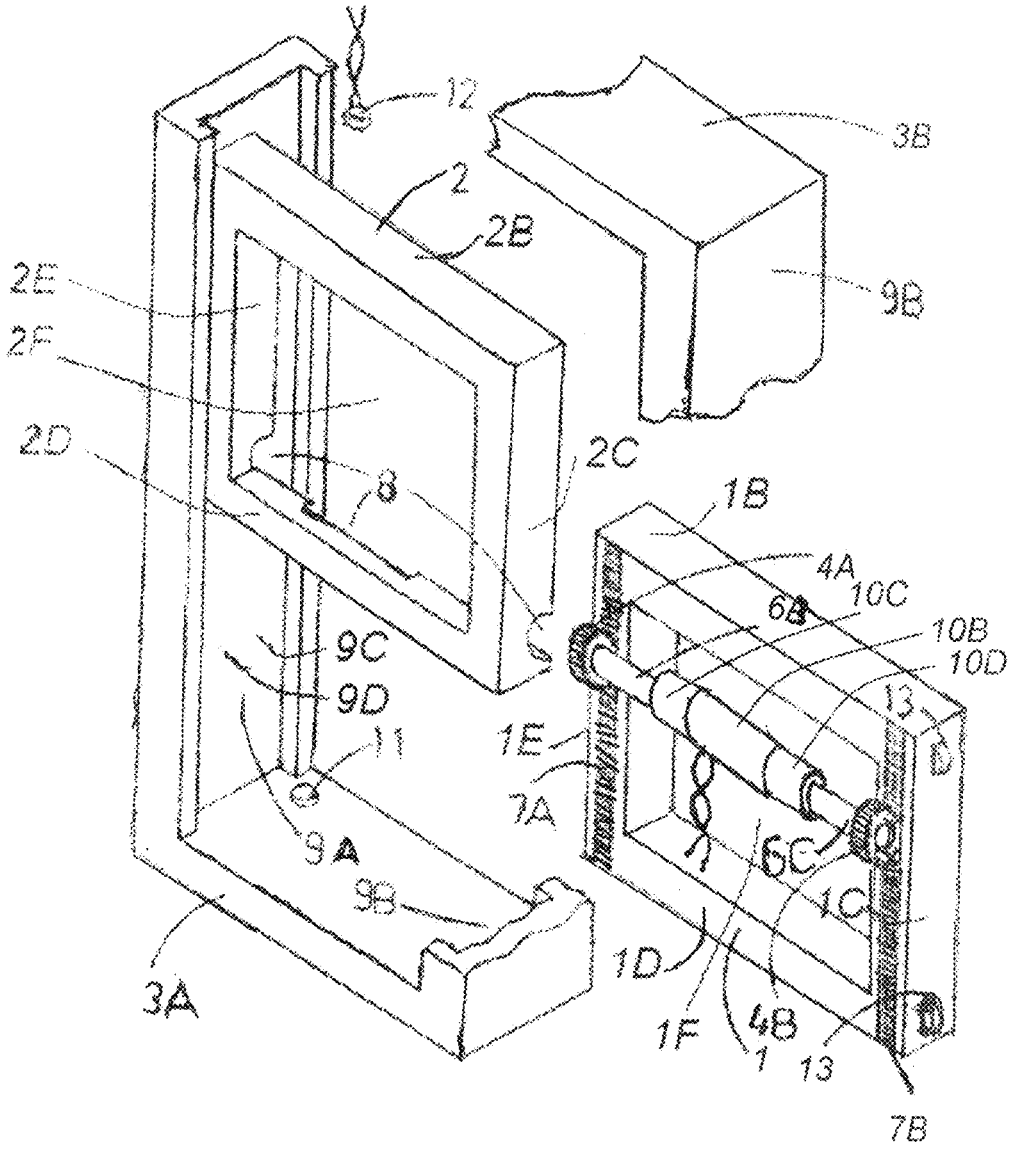
FIG. 2 illustrates in 3D isometric drawing a disassembled view of the entire sliding window mechanism.

FIG. 2 illustrates in 3D isometric drawing a disassembled view of the entire sliding window mechanism. FIG. 2 describes the recess motor option of the driving mechanism. The sliding frame 1 is depicted separately from the static pane 2F which is framed by the static frame 2. The static window 2 i.e. the static frame 2, includes the left vertical static plank 2E, the right vertical static plank 2C, the lower horizontal static plank 2D and the upper horizontal static plank 2B. The sliding frame 1 which holds the sliding pane 1F is composed of the left vertical sliding plank 1E, the right vertical sliding plank 1C, upper horizontal sliding plank 1B and the lower horizontal sliding plank 1D. The static frame 2 is installed between the outer frame right vertical guide 9B and the left outer frame vertical guide 9A which is connected to the lower outer horizontal bar 3A and to the upper outer horizontal bar 3B. To allow better viewing, the rest of the outer frame is depicted in pieces. The opposite outer frame's right vertical guide 9B is shown in two pieces where one piece is connected to the outer frame upper horizontal bar 3B and the second piece of outer frame's right vertical guide 9B is connected to the outer frame lower horizontal bar 3A. The outer frame right vertical guide 9B and the left outer frame vertical guide 9A are divided into the first and second tracks 9C and 9D respectively. The static frame 2 also has at its lower static horizontal plank 2D a recess 8 which is used to house the recess motor system which includes: an electric motor 10B mechanically connected to a left gearbox 10C and also mechanically connected to a right gearbox 10D. The left gearbox 10C has an output left axle 6B. The right gearbox 10D has an output right axle 6C. The left end of the output left axle 6B is coupled with the left pinion 4A. The right end of the output right axle 6C is coupled with the right pinion 4B.

The recess 8 is configured to house the left pinion 4A, the output left axle 6B, the left gearbox 10C, the electric motor 10B, the right gearbox 10D, the output right axle 6C and the right pinion 4B. Turning the electric motor 10B facilitates turning of the left gearbox 10C the output left axle 6B and the left pinion 4A. Turning the electric motor 10B also facilitates turning of the right gearbox 10D the output right axle 6C and the right pinion 4B. Turning the left pinion 4A and the right pinion 4B move vertically the sliding window 1. Since both the left gearbox 10C and the right gearbox 10D are connected to the same electric motor 10B their output left axle 6B and output right axle 6C and their connected pinions 4A and 4B turn exactly at the same speed when the electric motor 10B is being turned. This causes the left rack 7A and the right rack 7B which are engaged with the pinions to move vertically with the same speed when the electric motor 10B turns the pinions.

The left pinion 4A is engaged with the left rack 7A which is installed on the inner side of the left vertical sliding plank 1E of the sliding frame 1. The right pinion 4B is engaged with the right rack 7B which is installed on the inner side of the right vertical sliding plank 1C of the sliding frame 1. Two out of four rollers 13 (only two rollers are shown in FIG. 2) are installed at two recesses carved at the left side of the vertical left sliding plank 1E of the sliding frame 1 and the other two rollers 13 are installed at two recesses carved at the right side of the vertical right sliding plank 1C of the sliding frame 1.

A lower limit switch 11 and an upper limit switch 12 are electrically connected to the control unit 15A and facilitate stopping the sliding frame at its lowest and highest positions respectively.

Figure 3:
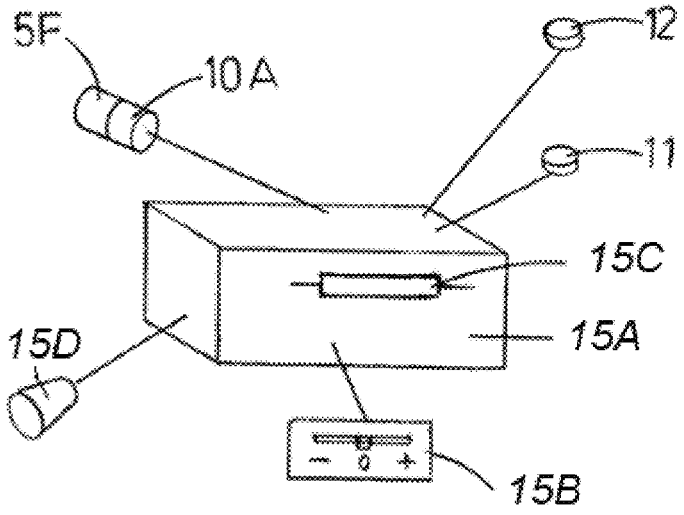
FIG. 3 depicts the electrical control system 15A.

FIG. 3 depicts the electrical control system 15A. In the electric motorized option, the electrical system also includes a control unit 15B that enables the user to control the direction and speed of the sliding window motion. In addition, the electrical option includes two limit switches 11 and 12 which are installed in the outer frame. Limit switch 12 stops the sliding frame when it reaches its highest position and limit switch 11 stops the sliding frame when it reaches its lowest position.

The control unit 15A which controls the motor is equipped with a safety circuit which includes an electrical overload sensor 15C which can detect a sudden overload of the motor's 10A current (or to detect current overload of the motor 10B in the recess motor option). Such an overload could occur when the sliding window is in the process of closing and it hits an obstruction of a person or an object. Thus, when the overload sensor 15C detects an obstruction it instructs the control unit 15A to reverse the motor turning direction 10A which then opens the sliding window 1 (or reversing recess motor 10B in the recess motor option).

The electrical system also includes a burglar alarm circuit 15D, which sounds the alarm when the sliding frame 1 is forced open while the alarm system is armed.

What is claimed is:

1. A window mechanism configured for opening and closing a sliding window comprising:

an outer frame, a static window, and a driving mechanism;

wherein the sliding window comprising: a sliding frame, a sliding pane, a left rack and a right rack;

wherein the sliding pane is configured to be framed within the sliding frame;

the sliding frame is constructed from a left vertical sliding plank, a right vertical sliding plank, a lower horizontal sliding plank and an upper horizontal sliding plank;

wherein the left rack is installed on an inner side of the left vertical sliding plank;

wherein the right rack is installed on an inner side of the right vertical sliding plank;

the static window comprising: a static frame, a static pane; wherein said static pane is configured to be framed within said static frame;

wherein the static frame is constructed from a left vertical static plank, a right vertical static plank, a lower horizontal static plank and an upper horizontal static plank;

the outer frame comprises: a left vertical guide, a right vertical guide, a lower horizontal outer bar and an upper horizontal outer bar;

wherein said left vertical guide is parallel to the right vertical guide; wherein said left vertical guide is facing the right vertical guide; wherein the left vertical guide and the right vertical guide both include a first track and a second track;

wherein the first track is parallel to the second track;

wherein the first track is configured to guide the sliding frame in sliding up and down within the outer frame;

wherein the static frame is installed in the second track; wherein a top side of the upper horizontal static plank is attached to a bottom side of the upper outer horizontal bar;

wherein a left pinion is engaged with the left rack and a right pinion is engaged with the right rack;

wherein the right rack and the sliding frame are configured to being vertically moved by turning the right pinion;

wherein the left rack and the sliding frame are configured to being vertically moved by turning the left pinion;

wherein, a single turn of the left pinion is configured to displace the left rack by a unit left displacement;

wherein, a single turn of the right pinion is configured to displace the right rack by a unit right displacement;

wherein the unit right displacement is configured to be equal to the unit left displacement;

wherein the driving mechanism further comprising:

a joint axle, a first axle and a first bevel gearwheel;

wherein a joint axle right end is coupled with a first axle left end; wherein a first axle right end is coupled with the first bevel gearwheel;

wherein the joint axle is coupled with the left pinion at a joint axle left end;

wherein the joint axle is coupled with the right pinion at the joint axle right end;

wherein, turning the joint axle also turns the left pinion and the right pinion;

wherein moving the sliding window up and down is facilitated by turning the joint axle;

wherein turning the first axle is configured to turn the right pinion, the joint axle and the left pinion;

wherein the lower horizontal static plank has a recess which is configured to house the left pinion, the joint axle and the right pinion;

wherein the driving mechanism further comprises: a motor gearbox, an electric motor mechanically coupled with the motor gearbox and a third bevel gearwheel;

wherein the motor gearbox includes a motor gearbox output axle which is coupled with the third bevel gearwheel; wherein, the third bevel gearwheel is engaged with the first bevel gearwheel;

wherein, actuating the electric motor is configured to turn the motor gearbox output axle and the third bevel gearwheel; turning of the third bevel gearwheel is configured to turn the first bevel gearwheel, the first axle, the right pinion, the joint axle and the left pinion;

wherein, actuating the electric motor facilitates turning of the left pinion and the right pinion;

wherein, actuating the electric motor facilitates moving vertically the sliding window.

2. The window mechanism of claim 1, wherein the sliding frame further comprising: a lower left roller, an upper left roller, a lower right roller and an upper right roller;

wherein the upper left roller is installed at an upper left side of the left vertical sliding plank;

wherein the lower left roller is installed at a lower left side of the left vertical sliding plank;

wherein the upper right roller is installed at an upper right side of the right vertical sliding plank;

wherein the lower right roller is installed at a lower right side of the right vertical sliding plank;

wherein, the upper left roller, the lower left roller, the upper right roller and the lower right roller facilitate sliding of the sliding frame within said outer frame.

3. The window mechanism of claim 2, wherein the lower left roller, the upper left roller, the lower right roller and the upper right roller are installed in frame recesses.

4. The window mechanism of claim 1, wherein said window mechanism further comprising: a control unit;

wherein the electric motor is electrically connected to the control unit; wherein the control unit controls a direction of the electric motor and a speed of the electric motor; wherein the control unit is electrically connected to a control box by which a user can manually control the direction of the electric motor and the speed of the electric motor;

wherein the electric motor is configured to move the sliding window up or down by turning the motor gearbox output axle.

5. The window mechanism of claim 4, further comprising: an overload sensor electrically connected to said control unit;

wherein said control unit is configured to reverse the direction of said electric motor when said overload sensor senses a sudden overload of said electric motor due to a blocking of said sliding window.

6. The window mechanism of claim 1, comprising: a lower limit switch and an upper limit switch; wherein said lower limit switch is configured to be activated when said sliding frame reaches a lowest position within said outer frame;

wherein said upper limit switch is configured to be activated when said sliding frame reaches a highest position within said outer frame;

wherein said lower limit switch and said upper limit switch are electrically connected to a control unit; wherein said control unit is configured to stop said electric motor when said lower limit switch or said upper limit switch is activated.

7. The window mechanism of claim 6, further comprising: a burglar alarm electrically connected to said control unit; wherein said lower limit switch is configured to activate said burglar alarm when said lower limit switch is deactivated while said burglar alarm is armed.

8. A window mechanism configured for opening and closing a sliding window comprising:

an outer frame, a static window, and a driving mechanism;

wherein the sliding window comprising: a sliding frame, a sliding pane, a left rack and a right rack;

wherein the sliding pane is configured to be framed within the sliding frame;

the sliding frame is constructed from a left vertical sliding plank, a right vertical sliding plank, a lower horizontal sliding plank and an upper horizontal sliding plank;

wherein the left rack is installed on an inner side of the left vertical sliding plank;

wherein the right rack is installed on an inner side of the right vertical sliding plank;

the static window comprising: a static frame, a static pane; wherein said static pane is configured to be framed within said static frame;

wherein the static frame is constructed from a left vertical static plank, a right vertical static plank, a lower horizontal static plank and an upper horizontal static plank;

the outer frame comprises: a left vertical guide, a right vertical guide, a lower horizontal outer bar and an upper horizontal outer bar;

wherein said left vertical guide is parallel to the right vertical guide; wherein said left vertical guide is facing the right vertical guide; wherein the left vertical guide and the right vertical guide both include a first track and a second track;

wherein the first track is parallel to the second track;

wherein the first track is configured to guide the sliding frame in sliding up and down within the outer frame;

wherein the static frame is installed in the second track; wherein a top side of the upper horizontal static plank is attached to a bottom side of the upper outer horizontal bar;

wherein a left pinion is engaged with the left rack and a right pinion is engaged with the right rack;

wherein the right rack and the sliding frame are configured to being vertically moved by turning the right pinion;

wherein the left rack and the sliding frame are configured to being vertically moved by turning the left pinion;

wherein, a single turn of the left pinion is configured to displace the left rack by a unit left displacement;

wherein, a single turn of the right pinion is configured to displace the right rack by a unit right displacement;

wherein the unit right displacement is configured to be equal to the unit left displacement;

wherein the driving mechanism further comprising:

a joint axle, a first axle and a first bevel gearwheel;

wherein a joint axle right end is coupled with a first axle left end; wherein a first axle right end is coupled with the first bevel gearwheel;

wherein the joint axle is coupled with the left pinion at a joint axle left end;

wherein the joint axle is coupled with the right pinion at the joint axle right end;

wherein, turning the joint axle also turns the left pinion and the right pinion;

wherein moving the sliding window up and down is facilitated by turning the joint axle;

wherein turning the first axle is configured to turn the right pinion, the joint axle and the left pinion;

wherein the lower horizontal static plank has a recess which is configured to house the left pinion, the joint axle and the right pinion;

wherein the driving mechanism further comprising:

a second bevel gearwheel, a crank axle and a crank;

wherein the crank is coupled with a crank axle right end;

wherein the second bevel gearwheel is coupled with a crank axle left end;

wherein, the second bevel gearwheel is engaged with the first bevel gearwheel;

wherein, turning the crank is configured to turn the crank axle and also to turn the second bevel gearwheel; turning of the second bevel gearwheel is configured to turn the first bevel gearwheel, the first axle, the right pinion, the joint axle and the left pinion;

wherein, turning the crank facilitates turning of the left pinion and the right pinion;

wherein, turning the crank facilitates moving vertically the sliding window.

* * * * *